US006253872B1

(12) United States Patent
Neumann

(10) Patent No.: US 6,253,872 B1
(45) Date of Patent: Jul. 3, 2001

(54) TRACK SOUNDPROOFING ARRANGEMENT

(75) Inventor: Bernhard Neumann, Gmunden (AT)

(73) Assignee: Gmundner Fertigteile Gesellschaft m.b.H & Co., KG, Gmunden (AT)

( * ) Notice: Subject to any disclaimer, the term of this patent is extended or adjusted under 35 U.S.C. 154(b) by 0 days.

(21) Appl. No.: 09/194,505

(22) PCT Filed: May 23, 1997

(86) PCT No.: PCT/AT97/00109

§ 371 Date: Nov. 24, 1998

§ 102(e) Date: Nov. 24, 1998

(87) PCT Pub. No.: WO97/45592

PCT Pub. Date: Dec. 4, 1997

(30) Foreign Application Priority Data

May 29, 1996 (AT) ..... 934/96
Jun. 11, 1996 (AT) ..... 1015/96

(51) Int. Cl.[7] ..... B64F 1/26; E04H 17/00; G10K 11/00

(52) U.S. Cl. ..... 181/210; 181/293; 105/452; 238/382

(58) Field of Search ..... 181/210, 293, 181/287, 286, 285, 284; 105/422, 452; 238/2, 9, 382

(56) References Cited

U.S. PATENT DOCUMENTS

| | | | | |
|---|---|---|---|---|
| 4,076,100 | * | 2/1978 | Davis | 181/290 |
| 4,093,120 | | 6/1978 | Canfield . | |
| 4,142,468 | * | 3/1979 | Birnstiel | 104/124 |
| 4,289,273 | * | 9/1981 | Schmidt | 238/8 |
| 4,960,184 | * | 10/1990 | Woodward et al. | 181/287 |
| 5,587,564 | * | 12/1996 | Stief et al. | 181/295 |
| 5,730,548 | * | 3/1998 | Brero et al. | 404/27 |
| 5,942,736 | * | 8/1999 | Cortonesi | 181/289 |

FOREIGN PATENT DOCUMENTS

| | | |
|---|---|---|
| 634367 | 6/1978 | (CH) . |
| 132710 | 4/1990 | (CN) . |
| 209514 | 7/1993 | (CN) . |
| 305006 | 5/1997 | (CN) . |
| 2350759 | 4/1975 | (DE) . |
| 7711191 | 9/1978 | (DE) . |
| 3602313 | 7/1987 | (DE) . |
| 4243102 | 7/1993 | (DE) . |
| 4417402 | 11/1995 | (DE) . |
| 295 15 935 U | 1/1996 | (DE) . |
| 9400910 | 1/1996 | (NL) . |

OTHER PUBLICATIONS

Translation of NL 9400910A, Feb. 1996.*
Partial Translation of DE 29515935U1, Jan. 1996.*
Partial Translation of DE 4243102A1, Jul. 1993.*
"Untersuchungen zur Verringerung der Schallabstrahlung von Festen Fahrbahnen durch absorbierende Fahrbahnbelage" by Gunther Hauck et al., ETR 44 (1995), Jul., Aug., pp. 559–565.

* cited by examiner

*Primary Examiner*—Robert E. Nappi
*Assistant Examiner*—Edgardo San Martin
(74) *Attorney, Agent, or Firm*—Sughrue, Mion, Zinn, Macpeak & Seas, PLLC

(57) ABSTRACT

A noise control device for tracks (1) comprising sound-absorbing slabs (3) mounted at the rails (2) of the track (1), the slabs being supported on the rails (2) via elastic sections (5) and self-supportingly bridging the space between the rails (2). To improve silencing of the slabs (3) it is provided for the slabs (3) to be comprised of particles (9) of porous lightweight building material, which are combined by a binder. The slabs (3) have an embedded reinforcement (11). Advantageously, also silencing cavity resonators (14) are formed in the slabs (3). A special embodiment provides for the space between the rails (2) of a track to be bridged by slab parts (3*a*, 3*b*) arranged in pairs which are supported on each other at their rims (26, 27) facing each other.

28 Claims, 5 Drawing Sheets

TRACK SOUNDPROOFING ARRANGEMENT

BACKGROUND OF THE INVENTION

The invention relates to a noise control device for tracks comprising sound absorbing slabs mounted at the rails of the track, the slabs being supported on the rails via elastic sections, the slabs arranged between the rails self-supportingly bridging the space between the rails. Furthermore, the invention relates to sound-absorbing slabs for such a noise control device.

In a noise control device of the above-mentioned type known from DE 36 02 313 A1, the slabs arranged between the rails of the track consist of three plies or layers supported on the rail base, on the rail web and on the lower side of the rail head via elastic sections. The upper layer consists of a passable woven steel wire whose rim is glued, welded or vulcanized into the section. The middle layer forms a sound absorption layer and consists of glass wool or rock wool. This sound absorption layer rests on the lower layer which is a perforated wall or grate and is supported in a recess of the section in the region of the rail base. According to a further embodiment, the slabs are also arranged on the rail outer side and upwardly angled at their ends so as to form a lateral noise control wall. Such slabs of mineral wool do provide sufficient silencing at high frequencies, yet at low frequencies their silencing is insufficient. Furthermore, this construction has the disadvantage that under higher and repeated loads, the passable perforated layer of woven steel wire may become detached from its anchoring in the sections so that the sound absorbing layer arranged therebelow may become damaged. Moreover, the dust penetrating the perforated layer may deposit on the upper side of the sound absorption layer and thus the silencing effect may increasingly deteriorate.

From NL-A-9400910 a noise control device for tracks is known, in which slabs made of wood fiber concrete are arranged between the rails of the track, which slabs rest on the sleepers of the track and laterally abut on the rails with elastic strips interposed. There is no self-supporting mounting of these slabs.

SUMMARY OF THE INVENTION

The invention has as its object to provide a noise control device for tracks comprising sound absorbing slabs which have good sound absorption or silencing over the entire range of frequencies essential for the noise levels of rail traffic, wherein also a lasting mechanical strength of the device is to be ensured.

In the noise control device of the initially defined type, according to the invention this object is achieved in that the slabs are comprised of particles of porous lightweight building material combined by a binder and that the slabs have an embedded reinforcement and are arranged without cover. By this design, the aforementioned objects can be met well. The airborne sound particularly arising from the wheels of a rail vehicle and from the rails is absorbed at the surface of the slabs by the pores of the particles, and even when a structure having fine gaps between the particles is chosen, the sound can penetrate more deeply into the slab via gaps or channels present between the particles so as to be gradually completely silenced there. By reinforcing the slabs, also their passability is ensured.

To further improve the sound absorption properties of the slabs, it is advantageously provided that the upper side of the slabs is structured, and even better results being obtainable if the structuring is irregular.

Preferably, the upper side of the slabs is provided with ribs extending in parallel to the rails, resulting in a structuring which is easy to be constructed.

It is also advantageous if the ribs have a trapezoidal cross-section, since thus obliquely incident sound waves can be better absorbed.

An additional improvement of the sound absorption properties of the slabs is obtained in that cavity resonators having tubular sound apertures directed to the upper side of the slabs are formed in the slabs. In this manner, certain frequency ranges of the impacting sound waves purposefully can be better absorbed.

To increase the silencing effect of the cavity resonators, it is suitable if the walls of the cavity resonators and their sound apertures are provided with a silencing structuring, and/or if the walls of the cavity resonators and their tubular sound apertures are provided with a silencing layer.

According to a structurally simple embodiment it is provided that the cavities forming the cavity resonators are designed such that they widen downwardly and are open, and are covered by a lower plate. In a different, also structurally simple embodiment it is provided that the cavities forming the cavity resonators are designed such that they widen downwardly and are open and form a resonance cavity together with the rail bedding.

In practice, it has proven to be suitable if the dampened resonance frequency of the cavity resonators lies within a frequency range of from 150 to 1,000 Hz, preferably between 500 and 1,000 Hz.

Within the scope of the invention also a special embodiment is provided in which the installation and removal of the slabs to be provided between the two rails of a track can be effected in a very simple manner. This embodiment of the noise control device is characterized in that the space present between the two rails of a track is bridged with slab parts arranged in pairs, each engaging by at least one carrying rib in the fishing surfaces of the rails, the slab parts of each slab pair being supported on each other at their facing rims, carrying portions and resting portions following each other in meander-like alternating fashion at each slab part along the rim facing the other slab part, the carrying portions being formed by indentations originating from the slab upper side and extending as far as to the rim facing the other slab part, upwardly directed indentations originating from the slab lower side being formed below the resting portions, which indentations are shaped complementary to the indentations of the carrying portions, and that the resting portions of the one slab part rest on the carrying portions of the other slab part, and that the resting portions of the other slab part rest on the carrying portions of the one slab part With slab parts in a folded-up position, the hinge-like assembled zones of the slab parts of each slab pair can be simply nested in each other, whereupon the slab parts can be inserted between the rails without any problem by levelling the slab pair, and neither will the slab parts be pressed apart under the action of loads.

A preferred type of the last-mentioned embodiment, which is characterized in that at those surfaces on which the slab parts of one slab pair contact each other, projections and indentations shaped complementary to the projections are formed, the projections latchingly engaging in the indentations for a mutual latching of the slab parts, has the advantage that the positive fit of the slab parts of a slab pair will be ensured over very long periods of time even if unfavorable vibrations act on the slab parts.

In terms of as simple an insertion procedure as possible of the slab parts between the rails, which is to be effected with little expenditure of force, and in terms of a possible simple removal of the slab parts it is advantageous if it is provided that the carrying surfaces provided in the carrying portions, starting from the rim facing the other slab part of the slab pair, at first rise steeply, starting from the slab lower side, and then flatten. There, it is furthermore suitable and also advantageous for ensuring a stable positive fit of the slab parts over extended periods of time in their installed state, if it is provided that the carrying surfaces provided in the carrying portions have a crowned shape, which shape inhibits a mutual movement of these slabs in the direction of the slab plane in the levelled position of the slab parts of the respective slab pair. Such a crowned shape may be formed on one slab part by a surface portion originating from the rim facing the other slab part of the slab pair, which surface portion extends away from the lower side of the slab, and a consecutive surface portion which extends towards the lower side of the slab. If with such a design of the slab parts it is desired to provide for an additional latching, it is advantageous if the latter is designed such that downwardly extending projections are provided at the front rims of the resting portions, and indentations complementary to these projections are provided on the carrying surfaces of the carrying portions.

Particularly suitable for the course of the levelling procedure during the installation of the slab parts and for attaining as stable a position as possible of the two slab parts of a slab pair relative to each other in the installed state is an embodiment which is characterized in that the crowned carrying surfaces are shaped like a toothing which allows for a sliding movement or rolling movement of the facing carrying surfaces and resting surfaces one on the other up to a levelled position of the slab parts of the respective slab pair, and which in the levelled position of these slab parts locks against a movement of these slab parts relative to each other.

Furthermore, there results a geometry favourable for the assembly of the slab parts of a slab pair and for the subsequent relative movement of these two slab parts during the installation procedure of the slab parts, if it is provided for the slab parts to be rounded at their facing rims from the plate lower side upwards, the radius of curvature being equally dimensioned or smaller than the distance between these rims and the rail-side rims of the slab parts. For as simple an assembly as possible of the slab parts of a slab pair it is advantageous if it is provided for the two slab parts of a slab pair to abut each other at the slab lower side approximately along a straight line. If, however, as high a carrying capacity as possible of the slab pair is to be attained, it is suitable if it is provided for the two slab parts of a slab pair to abut each other at the slab lower side so as to engage into each other in meander-like fashion.

With a view to the construction of the slab parts themselves it is suitable if the reinforcement provided in the slab parts extends over the slab area and reaches both into the carrying portions and resting portions and into the carrying ribs. It is also suitable if it is provided that an elastic and/or shock-braking insert or coating is provided between the carrying surfaces provided on the carrying portions and the resting surfaces provided on the resting portions.

A sound-absorbing slab according to the invention is characterized in that the slab is comprised of particles of porous lightweight building material combined by a binder, that the slab has an embedded reinforcement, and that in the slab cavity resonators are formed with tubular sound apertures oriented towards the one large surface of the slab, which large surface is to form the upper side when installing the slab in the track. Therein, it is advantageous if the cavities forming the cavity resonators are designed to widen and to be open towards that large surface which is located at that side of the slab that faces away from the tubular sound apertures. Therein, a further development is characterized in that the cavities forming the cavity resonators are covered by a lower plate at the side facing away from the tubular sound apertures. Embodiments of a slab configured according to the invention which are provided for the previously mentioned configuration comprising slab parts to be assembled to a slab pair are characterized in that the slab is comprised of particles of porous lightweight building material combined by a binder, that the slab has an embedded reinforcement, that the slab on one rim side is provided with a carrying rib for engagement in the fishing surfaces of rails, and, at the rim side opposite this carrying rib, comprises meander-like successive carrying portions and resting portions, the carrying portions being formed by indentations originating from the slab upper side and extending as far as to the rim, upwardly directed indentations originating from the slab lower side being formed below the resting portions and being shaped complementary to the indentations of the carrying portions. Preferably, it is there provided that in the slab cavity resonators are formed with tubular sound apertures oriented towards the one large surface of the slab, which large surface is to form the upper side when installing the slab in the track. Here, it is furthermore suitable if the reinforcement provided in the slab extends over the entire slab area and into the carrying portions and into the resting portions as well as into the carrying rib. If desired, the slabs or the slab parts may also be provided with a frame extending along the rim and preferably consisting of metal or fiber-reinforced plastic.

BRIEF DESCRIPTION OF THE DRAWINGS

In the following the invention will be further explained with reference to the drawings. In the drawings.

DETAILED DESCRIPTION OF THE INVENTION

Figure 1:
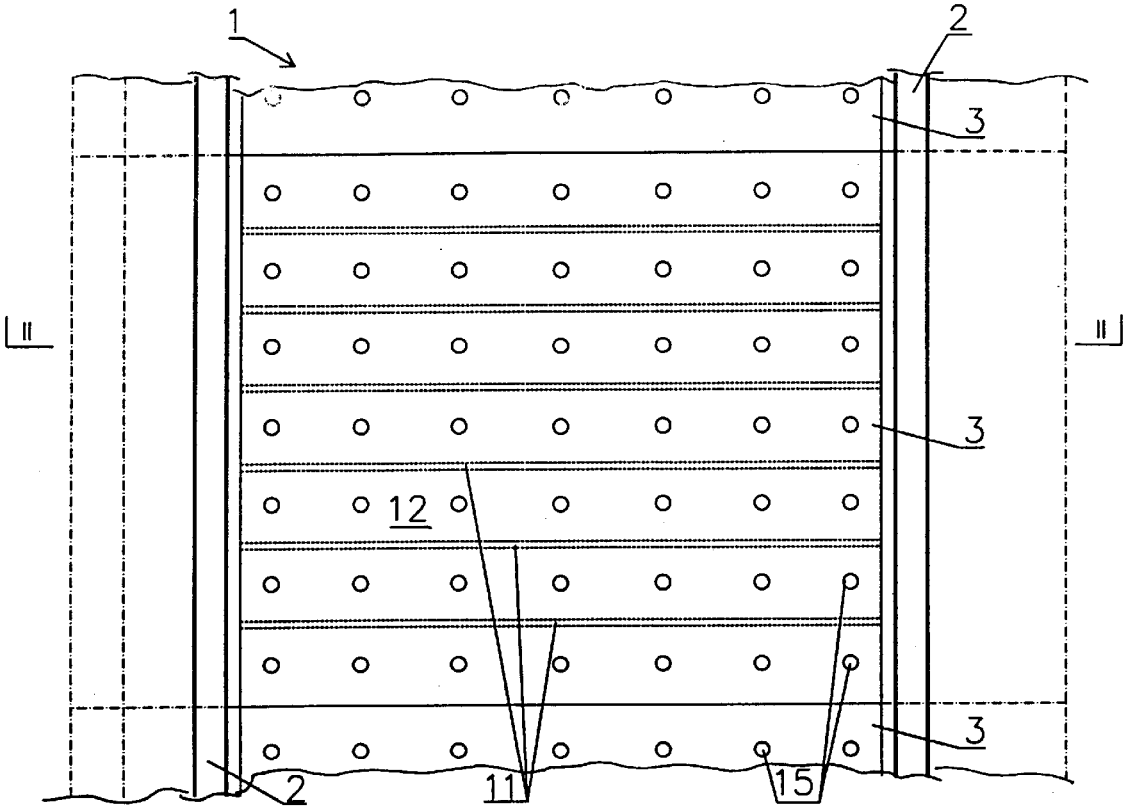
FIG. 1 shows a top view onto a track having sound-absorbing slabs arranged between its rails.
Figure 2:
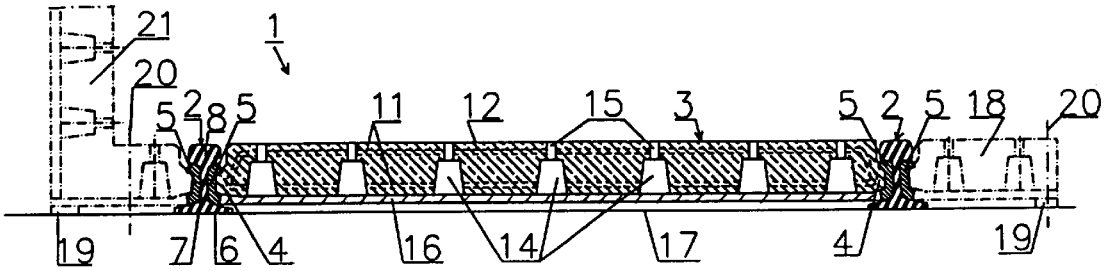
FIG. 2 shows a section according to line II—II of FIG. 1.
Figure 3:
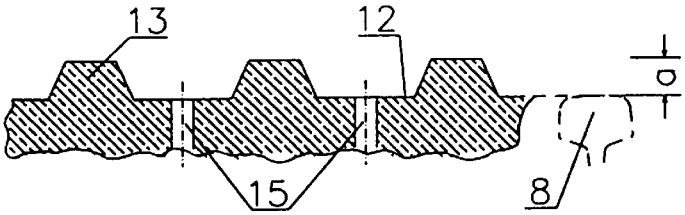
FIG. 3 shows an embodiment of a slab, in cross-section.
Figure 4:
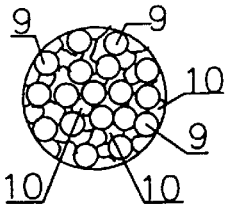
FIG. 4 shows an enlarged detail of the surface of the slab according to FIG. 2 or 3.

At the track 1 illustrated in FIGS. 1 and 2, sound-absorbing slabs 3 are adjacently arranged between the rails 2 in the longitudinal direction of the track. On both of their rims which extend along the rails 2, the generally rectangular slabs 3 comprise projecting carrying ribs 4 which rest on the rail base 6, on the rail web 7 and on the lower side of the rail head 8 of the rails 2, with elastic sections 5, e.g. of rubber or elastomer, interposed. The slabs 3 whose surface is represented on an enlarged scale in FIG. 4, are comprised of particles 9 of porous lightweight building material combined by a suitable binder. As the lightweight building material, synthetic material granules, granular or spherical and burnt alumina particles, granular slag particles or the like burnt natural or synthetically produced materials may, e.g., be used, these particles being punctually connected by means of a suitable synthetic binder or cement so that small gaps or channels 10 remain which allow for a transmission of airborne sound and the drainage of penetrating rain or melt water. To provide the slabs 3 with sufficient mechanical strength so as to make the slabs 3 passable, the slabs 3 are provided with a reinforcement 11, e.g. of steel or of other metals, fiber-reinforced plastic, glass fiber mats or the like. The airborne sound incident on the slabs 3 is absorbed at the surface of the slabs 3 by the pores of the particles 9 and can penetrate more deeply into the slab 3 via the gaps or channels 10 remaining between the particles 9 to be gradually absorbed there. To increase this sound absorption effect, the surface of the slabs 3 can be enlarged by structuring. Thus, e.g., the upper side 12 of the slabs 3 may be provided with ribs 13 extending in parallel to the rails 2 and arranged in spaced relationship to each other, which ribs 13, as is illustrated in FIG. 3, have a trapezoidal cross-section and a height a above the rail head 8 which does not exceed a permissible amount of, e.g., 5 cm. Structuring may also be irregular, e.g. by the distance of the ribs 13 from each other increasing or decreasing. As the structuring of the upper side 12, e.g. also truncated cones, truncated pyramids, cylinders, cuboids etc. may be provided, which are arranged either at equal or at varying distances from each other.

To further increase the previously mentioned sound absorption effect in a broad range of frequencies of the sound level, cavity resonators 14 are formed in the slabs 3 in the manner of Helmholtz resonators whose tubular sound apertures 15 are provided at the upper side 12 of the slabs 3. In the embodiment illustrated in FIG. 2, the cavities forming the cavity resonators 14 are frustoconical and open towards the bottom, the apertures thus formed being covered by a lower plate 16 which is, e.g., glued to the slab 3 to form the cavity resonator 14. It may also be advantageous to leave the cavities forming the cavity resonators open towards the bottom so that they form a resonance cavity together with the space present between the rail bedding 17 merely schematically illustrated by a dot-and-dash line (e.g. sleepers of the track and bed of broken stones or concrete slab substructure) and the lower side of the respective slab 3. The cavities forming the cavity resonators 14 may also have a shape other than frustoconical, they may e.g. be spherical, cylindrical, pyramidal etc., to achieve a different frequency behaviour at sound absorption. Likewise, the volumes of the cavity resonators 14 and the dimensions of the tubular sound apertures may be varied to achieve the desired frequency behaviour or frequency absorption spectrum, respectively. The tubular sound apertures 15 open, as is illustrated in FIG. 2, at right angles to the upper side 12 of the slab 3. As a variation of this arrangement, the tubular sound apertures 15 may also end obliquely to the upper side 12 of the slabs 3 so that they can better receive obliquely incident sound waves.

The slabs 3 with the cavity resonators 14 may be produced in a rectangular mould in which positive moulds of the cavity resonators are inserted with attached tube pieces for the sound apertures, whereupon the mould is filled with the particles 9 and a binder, and the mould is opened after setting of the binder. As the positive moulds, also prefabricated cavity resonators with attached tube pieces as sound apertures may be inserted in the mould which are either comprised of a suitable sound absorbing material or are provided with a layer of sound absorbing material at their inner surface.

As is illustrated in FIG. 2, sound absorbing slabs having cavity resonators may also be provided on the outer side of the rails 2. The slab 18 illustrated in dot-and-dash line at the right-hand rail 2 is supported at one end on the rail 2 via an elastic section 5, similar to the slab 3 arranged between the rails 2, and at the other end it is supported via an elastic strip 19 and fixed by means of a fastening element, in particular a screw 20. Slab 21 illustrated also in dot-and-dash line at the left-hand rail 2 is supported and fixed in the same manner as slab 18, yet on its outer side it has an upwardly angled end region so as to form a noise control wall. The two slabs 18, 21 also include a reinforcement (not illustrated) as well as optionally a structuring in the form of ribs (not illustrated). If desired, the slabs may also be provided with a frame extending along their rim.

Figure 5:
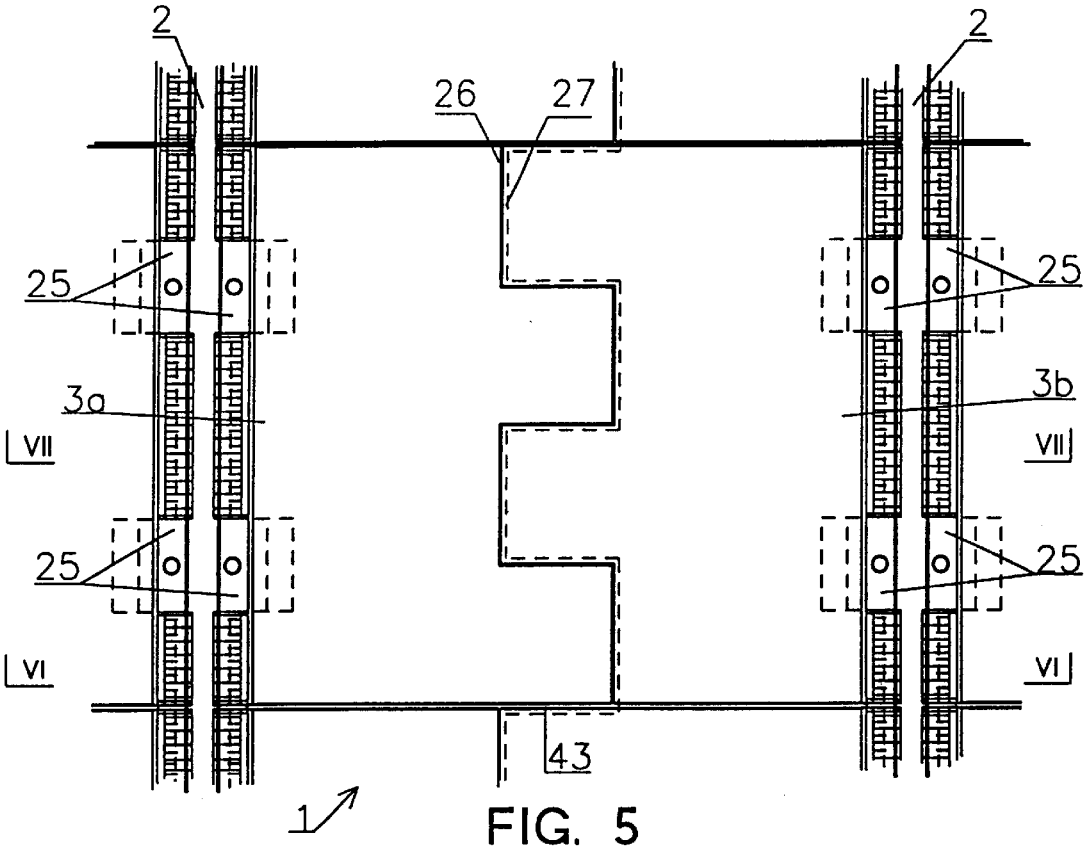
FIG. 5 shows an embodiment of a noise control device which comprises divided slab parts, in top view.
Figure 6:
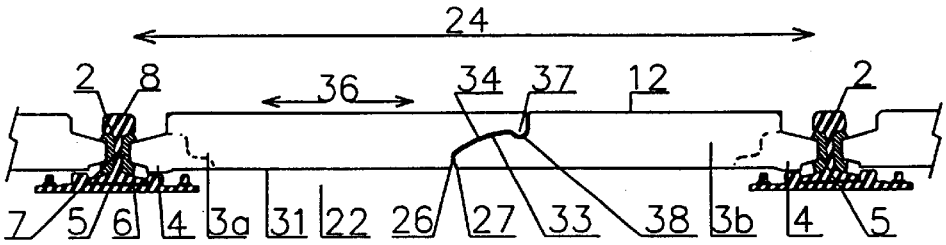
FIG. 6 shows this embodiment in a section according to line VI—VI of FIG. 5.
Figure 7:
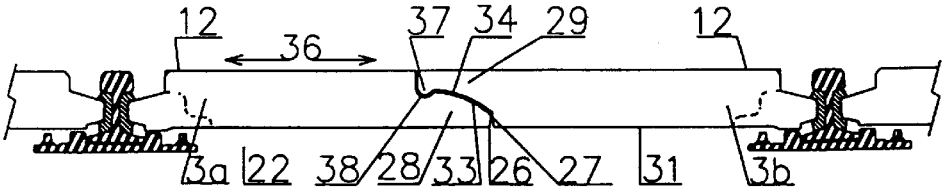
FIG. 7 shows this embodiment in a section according to line VII—VII of FIG. 5.

In the embodiment of a noise control device according to the invention and illustrated in FIGS. 5 to 7, the space 22 present between the two rails 2 of a track 1 is filled or bridged, respectively, by sound-absorbing slab parts 3*a*, 3*b* arranged in pairs. These slab parts 3*a*, 3*b* comprise carrying ribs 4 engaging in the fishing surfaces 23 of the rails 2, and elastic sections 5 of approximately C-shaped cross-section are inserted between the carrying ribs 4 and the rails 2. In this manner, the slab parts 3*a*, 3*b* are supported on the rail base 6 by their carrying ribs 4, are resting laterally against the rail web 7, and upwardly they are held by engagement under the rail head 8. The combined slab parts 3*a*, 3*b* bridge the distance 24 between the rails 2 self-supportingly. On each of the slab parts 3*a*, 3*b* several carrying ribs 4 are provided in spaced relationship from each other so as to keep the fastening elements 25 provided for the rails 2 accessible. However, when choosing different slab dimensions and slab installation arrangements, also just a single carrying rib 4 may be provided on each slab part.

At their rims 26, 27 facing each other, the slab parts 3*a*, 3*b* of each slab pair are supported on each other, each slab pair thus forming an assembled body self-supportingly bridging the distance 24 between the rails 2. For this, carrying portions 28 and resting portions 29 following each other in meander-like alternating fashion are provided at each slab part 3*a* and 3*b*, respectively, along the rims 26 and 27, respectively, facing the other slab part 3*b* and 3*a*, respectively; the carrying portions 28 are formed by indentations 30 originating from the slab upper side 12, which indentations extend as far as to the rim facing the other slab part; below the resting portions 29, upwardly directed indentations 32 originating from the slab lower side 31 are formed, and the resting portions of the slab part 3*a* rest on the carrying portions of the slab part 3*b*, and the resting portions of the slab part 3*b* rest on the carrying portions of the slab part 3*a*; the indentations 30 are designed to be complementary to the indentations 32, so that the resting surfaces 34 formed by the indentations 32 on the resting portions 29 rest with a substantially snug fit on the carrying surfaces 33 formed by the indentations 30 on the carrying portions 28. As regards the afore-mentioned design of the slab parts, reference may also be made to the illustration of such a slab part in FIG. 8.

Figure 9:
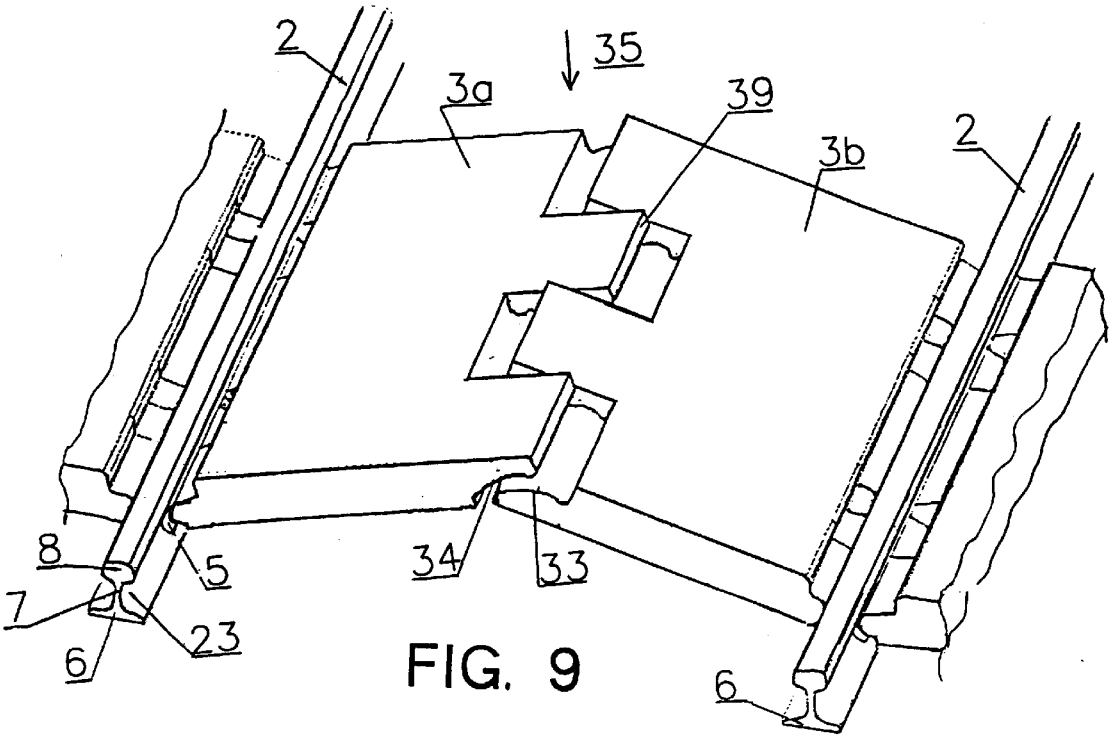
FIG. 9 shows a pair of such slab parts, also in an axonometric view, in a folded-up state while they are being installed.

To insert the slab parts 3*a*, 3*b* in pairs between the rails 2 of a track, they may at first be arranged in the folded-up position and put together with their meander-like designed rims 26, 27, as is illustrated in FIG. 9, the elastic sections 5 of C-shaped cross-section also being arranged between the carrying ribs 4 of the slab parts 3*a*, 3*b* and the rails 2. Subsequently, the slab parts 3*a*, 3*b* are downwardly pivoted or folded, as indicated by the arrow 35, until they assume the levelled position illustrated in FIGS. 5 to 7, in which the slab parts 3*a*, 3*b* of each slab pair self-supportingly bridge the space 22 between the rails 2.

The carrying surfaces 33 provided in the carrying portions 28 have a crowned shape, and such a crowned shape is also found on the resting surfaces 34 provided on the resting portions 29, and by this crowned shape of the above-indicated surfaces, a positive locking of the slab parts 3*a*, 3*b* is provided which inhibits mutual movement of these slab parts in the direction of the slab plane (arrows 36) in the levelled position of the slab parts 3*a*, 3*b*. Furthermore, projections 37 are provided on the resting surfaces 34 and indentations 38 are provided on the carrying surfaces 38, which are shaped complementary to the projections 37; in the levelled position of the slab parts, the projections 37 latchingly engage in the indentations 38 resulting in a mutual latching of the slab parts 3*a*, 3*b*.

If desired, an elastic and/or shock-braking insert or coating can be provided between the carrying surfaces 33 and the resting surfaces 34.

Originating from the rim 26 or 27 of the respective slab part 3*a* or 3*b*, respectively, the carrying surfaces 33 provided on the carrying portions at first rise steeply, starting from the slab lower side 31, and then flatten, which is advantageous for assembling the slab parts to slab pairs. From the geometrical standpoint it is suitable if such crowned carrying surfaces are shaped like a toothing which allows for a relative sliding movement or rolling movement of the facing carrying surfaces and resting surfaces one on the other, up to a levelled position of the slab parts 3*a*, 3*b* of the respective slab pair, and which then, in the levelled position (FIGS. 5 to 7), locks these slab parts 3*a*, 3*b* against a movement relative to each other. This surface shape which geometrically corresponds to a toothing may extend as far as to the slab upper side 12.

The projections 37 may be provided at the front rims 39 of the resting portions 29, as is illustrated in FIGS. 5 to 8, as may be advantageous when assembling the slab parts; it is, however, also possible to mould such projections 37 at a different location, e.g. at a slight distance from the rim of the resting surfaces.

Figure 10:
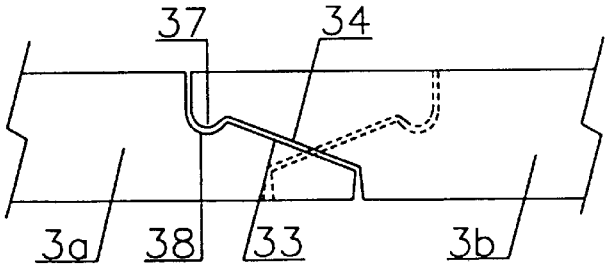
FIG. 10 shows a modification with respect to the design of the carrying portions and resting portions in a sectional representation corresponding to that of FIG. 7.
Figure 11:
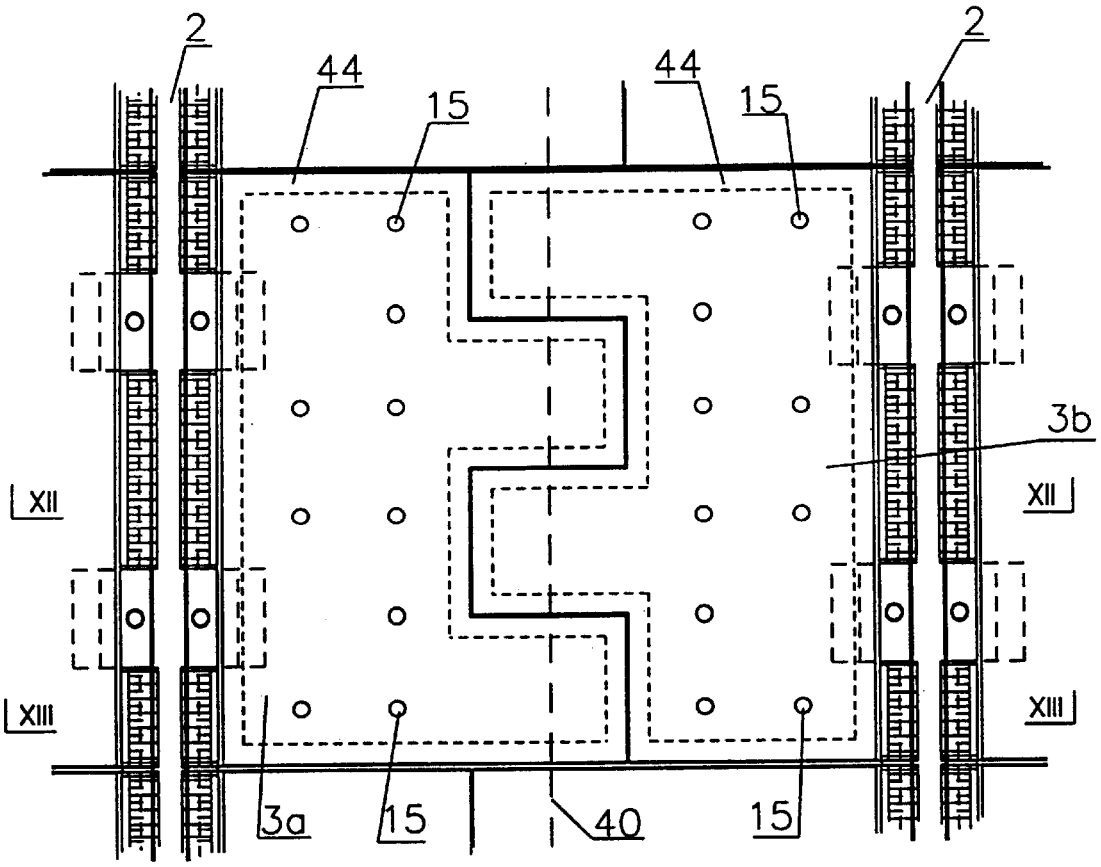
FIG. 11 shows another embodiment of a noise control device comprising divided slab parts, in top view.
Figure 12:
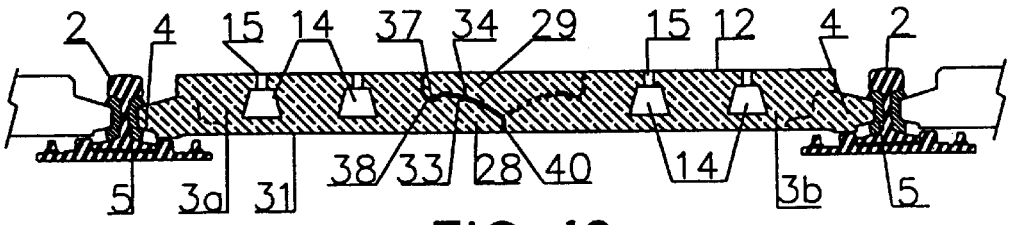
FIG. 12 shows this embodiment in a section according to line XII—XII of FIG. 11.
Figure 13:
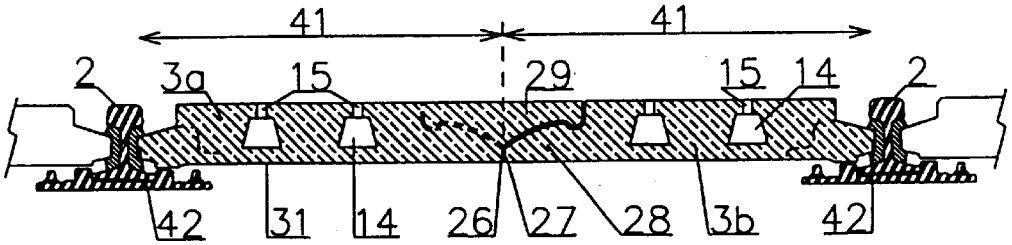
FIG. 13 shows this embodiment in a section according to line XIII—XIII of FIG. 11.
Figure 14:
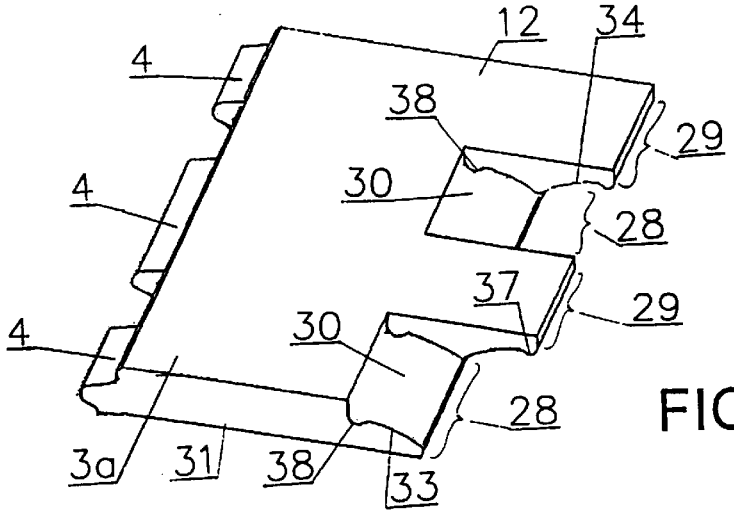
FIG. 14 shows a slab part provided in a noise control device according to FIG. 11, in axonometric view.
Figure 15:
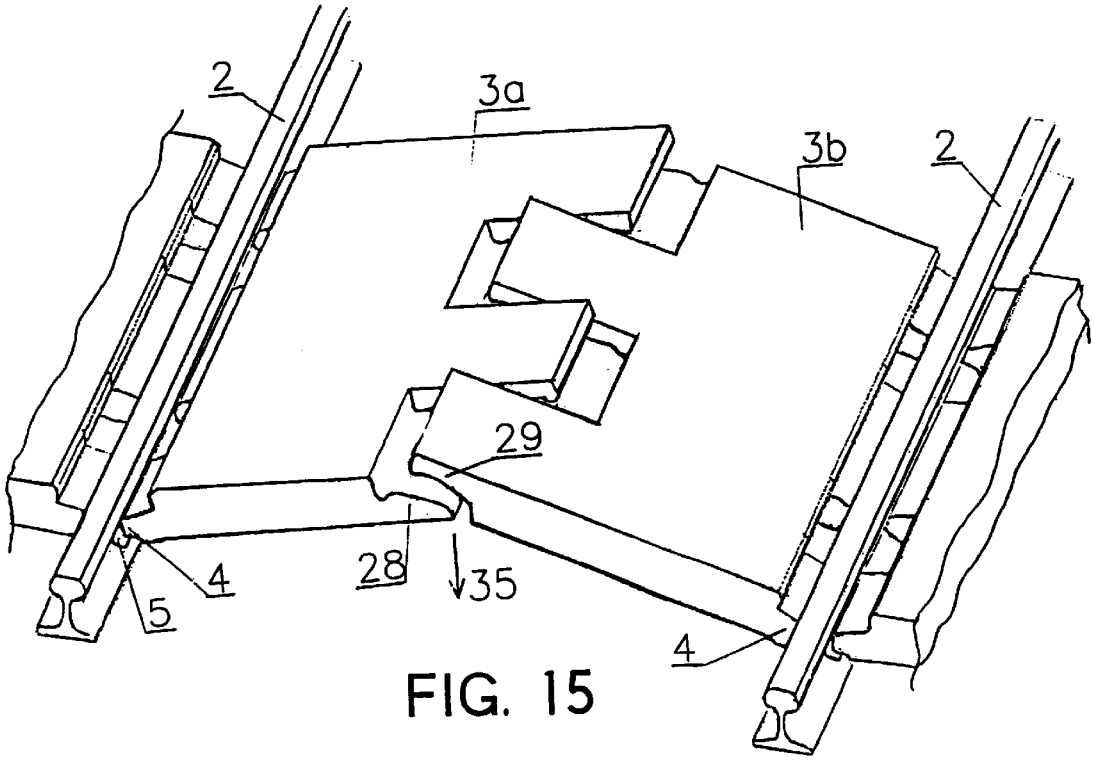
FIG. 15 shows a pair of such slab parts in a folded-up state in the course of the insertion procedure, also in an axonometric view.
Figure 16:
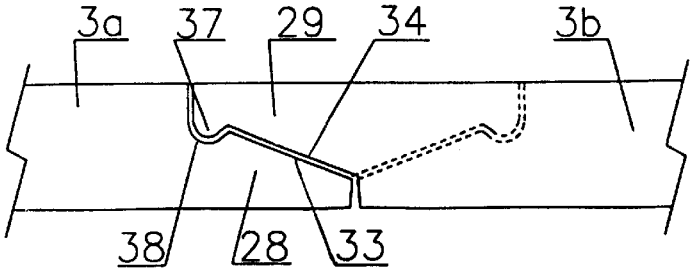
FIG. 16 shows a modification with respect to the design of the carrying portions and the resting portions of the divided slab parts in a sectional representation corresponding to that of FIG. 13.

In the modification illustrated in FIG. 10, the carrying surfaces 33 and the resting surfaces 34 are configured to be largely plane; also in this instance, the indentations 38 in which the projections 37 engage are provided for a mutual latching of the slab parts 3*a*, 3*b*.

Both in the embodiment illustrated in FIGS. 5 to 7 and in the modification illustrated in FIG. 10, the two slab parts 3*a*, 3*b* of a slab pair rest on each other to engage meander-like on the slab lower side 31, so that the facing rims of the slab parts 3*a*, 3*b* extend to follow a meander-like line 43 at the slab lower side. This results in a very intimate positive fit of the slab parts 3*a*, 3*b* which together form a slab pair.

Yet the design of the mutually contacting or engaging portions of the slab parts of a slab pair may also be chosen such that the facing rims 26, 27 of the slab parts 3*a*, 3*b* abut each other at the slab lower side 31 along a straight line 40, whereby both the production of the slabs and the course of the assembling procedure can be simplified; such a design is present in the embodiments illustrated in FIGS. 11 to 16. Many details of these embodiments are analogous to those of the embodiments of FIGS. 5 to 10, and therefore reference may be made in this connection to the previous explanations relating to FIGS. 5 to 10. With the embodiment according to FIGS. 11 to 14, the carrying surfaces 33 have a crowned shape, while in the modification according to FIG. 16, these carrying surfaces 33 have a substantially plane configuration. In both instances, projections 37 engaging in indentations 38 are arranged at the front rims of the resting portions. Yet, as has already been mentioned above, such projections 37 may also be placed at different locations in the region of the resting surfaces.

In the embodiments illustrated in FIGS. 11 to 16, the slab parts 3*a*, 3*b* are shaped to be rounded at their facing rims 26, 27 from the plate lower side 31 upwards, the radius of curvature of this rounded portion being equally dimensioned or smaller than the distance 41 between the rims 26, 27 and the rail-side rims 42 of the slab parts 3*a*, 3*b*. Also this measure is advantageous for as unimpeded a course of the insertion procedure of the slab parts as possible.

Figure 8:
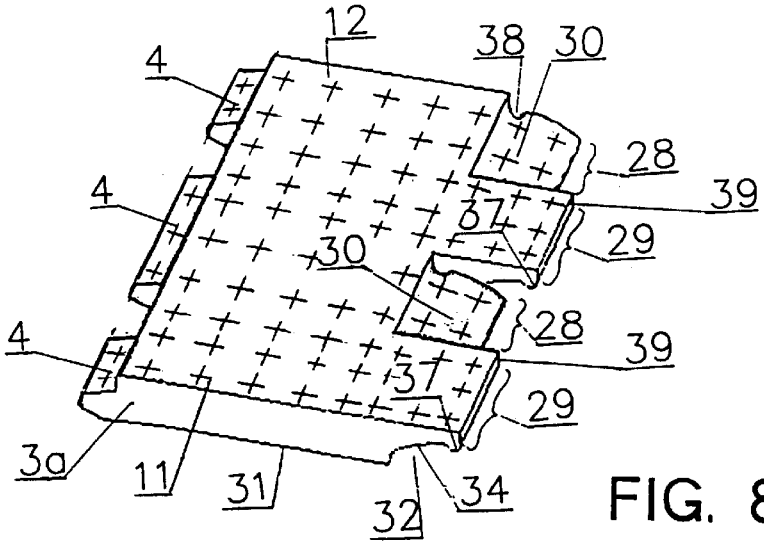
FIG. 8 shows a slab part provided in such a covering, in an axonometric view.

According to a preferred embodiment it is provided that the reinforcement 11 provided in the slab parts extends over the entire area of the slab parts 3*a*, 3*b*, reaching, as is indicated in broken lines in FIG. 8, both into the carrying portions 28 and resting portions 29 and into the carrying ribs 4.

Also in the embodiments formed with the slab parts 3*a*, 3*b*, cavity resonators 14 including sound apertures 15 can be provided, as is illustrated, e.g., in FIGS. 11 to 14. Likewise, the slabs can also be provided with frames 44, as is illustrated in broken lines, e.g., in FIG. 11.

What is claimed is:

1. A noise control device for tracks comprising sound absorbing slabs mounted at the rails of the track, the slabs being supported on the rails via elastic sections, and the slabs arranged between the rails self-supportingly bridging the space between the rails, characterized in that the slabs (3; 18; 21) are porous and comprised lightweight building material combined by a binder and that the slabs (3; 18; 21) have a reinforcement (11).

2. A noise control device according to claim 1, characterized in that the upper side (12) of the slabs (3; 18; 21) is structured.

3. A noise control device according to claim 2, characterized in that the structuring is irregular.

4. A noise control device according to claim 2, characterized in that the upper side of the slabs (3; 18; 21) is provided with ribs (13) extending in parallel to the rails (2).

5. A noise control device according to claim 4, characterized in that the ribs (13) have a trapezoidal cross-section.

6. A noise control device according to claim 1, characterized in that cavity resonators (14) having tubular sound apertures (15) directed to the upper side (12) of the slabs (3; 18; 21) are formed in the slabs (3).

7. A noise control device according to claim 6, characterized in that the walls of the cavity resonators (14) and their sound apertures (15) are provided with a silencing structuring.

8. A noise control device according to claim 6, characterized in that the walls of the cavity resonators (14) and their tubular sound apertures (15) are provided with a silencing layer.

9. A noise control device according to claim 6, characterized in that the cavities forming the cavity resonators (14) are designed such that they widen downwardly and are open, and are covered by a lower plate (16).

10. A noise control device according to claim 6, characterized in that the cavities forming the cavity resonators (14) are designed such that they widen downwardly and are open and form a resonance cavity together with the space present between the rail bedding (17) and the lower side of the respective slab (3).

11. A noise control device according to claim 6, characterized in that the silenced resonance frequency of the cavity resonators (14) lies within a frequency range of from 150 to 1,000 Hz, preferably between 500 and 1,000 Hz.

12. A noise control device according to claim 1, characterized in that the space (22) present between the two rails (2) of a track (1) is bridged with slab parts (3*a*, 3*b*) arranged in pairs, each engaging by at least one carrying rib (4) in the fishing surfaces (23) of the rails (2), the slab parts (3*a*, 3*b*) of each slab pair being supported on each other at their facing rims (26, 27), carrying portions (28) and resting portions (29) alternatingly following each other in meander-like fashion at each respective slab part along the rim facing the other slab part, the carrying portions being formed by indentations (30) originating from the slab upper side (12), which indentations extend as far as to the rim facing the other slab part, upwardly directed indentations (32) originating from the slab lower side (31) being formed below the resting portions (29), which indentations are shaped complementary to the indentations of the carrying portions, and that the resting portions of the one slab part rest on the carrying portions of the other slab part, and that the resting portions of the other slab part rest on the carrying portions of the one slab part.

13. A noise control device according to claim 12, characterized in that at those surfaces (33, 34), on which the slab parts (3*a*, 3*b*) of one slab pair contact each other, projections (37) and indentations (38) shaped complementary to the projections are formed, the projections latchingly engaging in the indentations for a mutual latching of the slab parts (3*a*, 3*b*).

14. A noise control device according to claim 12, characterized in that the carrying surfaces (33) provided in the carrying portions (28), originating from the rim facing the other slab part of the slab pair, at first rise steeply, starting from the slab lower side (31), and then flatten.

15. A noise control device according to claim 14, characterized in that the carrying surfaces (33) provided in the carrying portions (28) have a crowned shape, which shape inhibits a mutual movement of the slab parts (3*a*, 3*b*) in the direction of the slab plane (36) in the levelled position of the slab parts (3*a*, 3*b*) of the respective slab pair.

16. A noise control device according to claim 13, characterized in that downwardly extending projections (37) are provided at the front rims (39) of the resting portions (29) and indentations (38) complementary to these projections (37) are provided on the carrying surfaces (33) of the carrying portions (28).

17. A noise control device according to claim 15, characterized in that the crowned carrying surfaces (33) are shaped like a toothing which allows for a sliding movement or rolling movement of the facing carrying surfaces and resting surfaces one on the other, up to a levelled position of the slab parts (3*a*, 3*b*) of the respective slab pair, and which in the levelled position of these slab parts locks against a movement of these slab parts relative to each other.

18. A noise control device according to claim 12, characterized in that the slab parts (3*a*, 3*b*) are shaped to be rounded at their facing rims (26, 27) from the plate lower side (31) upwards, the radius of curvature being equally dimensioned or smaller than the distance (41) between these rims (26, 27) and the rail-side rims (42) of the slab parts (3*a*, 3*b*).

19. A noise control device according to claim 12, characterized in that the two slab parts (3*a*, 3*b*) of a slab pair abut each other at the slab lower side (31) approximately along a straight line (40).

20. A noise control device according to claim 12, characterized in that the two slab parts (3*a*, 3*b*) of a slab pair abut each other at the slab lower side (31) so as to engage each other in meander-like fashion.

21. A noise control device according to claim 12, characterized in that the reinforcement (11) provided in the slab parts (3*a*, 3*b*) extends over the slab area (36) and reaches into the carrying portions (28) and resting portions (29) as well as into the carrying ribs (4).

22. A noise control device according to claim 12, characterized in that an elastic and/or shock-braking insert or coating is provided between the carrying surfaces (33) provided on the carrying portions and the resting surfaces (34) provided on the resting portions.

23. A sound-absorbing slab for a noise control device according to claim 1, characterized in that the slab (3; 18; 21) is comprised of particles (9) of porous lightweight building material combined by a binder, that the slab (3; 18; 21) has an embedded reinforcement (11), and that in the slab (3; 18; 21) cavity resonators (14) are formed with tubular sound apertures (15) oriented towards the one large surface of the slab (3; 18; 21), which large surface is intended to form the upper side when installing the slab in the track.

24. A sound-absorbing slab according to claim 23, characterized in that the cavities forming the cavity resonators (14) are designed to widen and to be open towards that large surface which is located at that side of the slab that faces away from the tubular sound apertures (15).

25. A sound-absorbing slab according to claim 24, charaterized in that the cavities forming the cavity resonators (14) are covered by a lower plate (16) at the side facing away from the tubular sound apertures (15).

26. A sound absorbing slab for a noise control device according to claim 12, characterized in that the slab (3*a*, 3*b*) is comprised of particles of porous lightweight building material combined by a binder, that the slab (3*a*, 3*b*) has an embedded reinforcement, that the slab (3*a*, 3*b*) on one rim side is provided with a carrying rib (4) for engagement in the fishing surfaces of rails and at the rim side opposite this carrying rib (4) comprises meander-like successive carrying portions (28) and resting portions (29), the carrying portions being formed by indentations (30) originating from the slab upper side (12) and extending as far as to the rim, upwardly directed indentations (32) originating from the slab lower side (31) being formed below the resting portions (29) and being shaped complementary to the indentations of the carrying portions.

27. A sound-absorbing slab according to claim 26, characterized in that in the slab (3*a*, 3*b*) cavity resonators (14) are formed with tubular sound apertures (15) oriented towards the one large surface of the slab (3*a*, 3*b*), which large surface is intended to form the upper side when installing the slab in the track.

28. A sound-absorbing slab according to claim 26, characterized in that the reinforcement (11) provided in the slab (3*a*, 3*b*) extends over the entire slab area and into the carrying portions (28) and into the resting portions (29) as well as into the carrying rib (4).

* * * * *